US006543235B1

(12) United States Patent
Crocker et al.

(10) Patent No.: US 6,543,235 B1
(45) Date of Patent: Apr. 8, 2003

(54) SINGLE-CIRCUIT FUEL INJECTOR FOR GAS TURBINE COMBUSTORS

(75) Inventors: David S. Crocker, Huntsville, AL (US); David L. Black, Madison, AL (US)

(73) Assignee: CFD Research Corporation, Huntsville, AL (US)

( * ) Notice: Subject to any disclaimer, the term of this patent is extended or adjusted under 35 U.S.C. 154(b) by 0 days.

(21) Appl. No.: 09/924,697

(22) Filed: Aug. 8, 2001

(51) Int. Cl.[7] ..... F02C 3/24

(52) U.S. Cl. ..... 60/776; 60/742; 60/748

(58) Field of Search ..... 60/740, 748, 742, 60/776; 239/405, 406

(56) References Cited

U.S. PATENT DOCUMENTS

| | | | | | |
|---|---|---|---|---|---|
| 2,607,193 | A | * | 8/1952 | Berggren | 60/748 |
| 3,866,413 | A | | 2/1975 | Sturgess et al. | 60/748 |
| 3,937,011 | A | | 2/1976 | Caruel et al. | 239/406 |
| 4,389,848 | A | | 6/1983 | Markowski et al. | 60/750 |
| 4,443,182 | A | * | 4/1984 | Wojcieson et al. | 431/183 |
| 4,845,940 | A | * | 7/1989 | Beer | 60/732 |
| 4,854,127 | A | | 8/1989 | Vinson et al. | 60/742 |
| 4,967,551 | A | * | 11/1990 | Faulkner | 60/804 |
| 5,224,333 | A | | 7/1993 | Bretz et al. | 60/39.06 |
| 5,256,352 | A | | 10/1993 | Snyder | 261/78.2 |
| 5,267,442 | A | * | 12/1993 | Clark | 60/748 |
| 5,359,847 | A | | 11/1994 | Pillsbury et al. | 60/748 |
| 5,402,633 | A | * | 4/1995 | Hu | 60/776 |
| 5,423,173 | A | | 6/1995 | Lemon et al. | 60/39.463 |
| 5,477,685 | A | | 12/1995 | Samuelson et al. | 60/737 |
| 5,505,045 | A | | 4/1996 | Lee et al. | 60/748 |

(List continued on next page.)

OTHER PUBLICATIONS

A general summary of the various types of fuel injectors for gas turbine engines is shown in the text of Lefebvre, *Gas Turbine Combustion* (1983) at Chapter 10 thereof.

Smith et al., Journal of Propulsion and Power, vol. 11, No. 2, Mar.–Apr. 1995, "Dual–Spray Airblast Fuel Nozzle for Advanced Small Gas Turbine Combustors", p. 244–251.

AIAA Paper No. AIAA–87–1826, 1987,entitled "Design and Test Verification of a Combustion System for an Advanced Turbo Fan Engine" by Sanborn et al.

ASME Paper No. 2000–GT–117 entitled "A New Hybrid Airblast Nozzle for Advanced Gas Turbine Combustors".

ASME Paper No. 2000–GT–0079 "Supression of Dynamic Combustion Instabilities by Passive and Active Means".

ASME Paper No. 92–GT–132 "Innovative High Temperature Aircraft Engine Fuel Nozzle Design" by Stickles et al., 1992.

Meyers et al., J. of Engr. for Gas Turbines and Power, vol. 114, p. 401, 1992, "Development of an Innovative High–Temperature Gas Turbine Fuel Nozzle".

ASME 93–GT–169, "Swirl Generation and Recirculation Using Radial Swirl Vanes", Halpin, 1993.

*Primary Examiner*—Ehud Gartenberg
(74) *Attorney, Agent, or Firm*—Waddey & Patterson; Lucian Wayne Beavers

(57) ABSTRACT

A single circuit fuel injector apparatus having a bifurcated recirculation zone is provided. The single circuit injector includes an injector tip having an aft facing tapered surface which is communicated with a plurality of fuel injector ports. A radially inward tapered conical air splitter directs sweep air over the tapered injector tip. An air blast atomizer filmer lip is disposed concentrically outward from the tapered tip. In a low power operating mode, fuel exiting the fuel injector ports is entrained within a centralized sweep air stream. In a high power operating mode, the majority of the fuel exiting the fuel injection ports has sufficient momentum to carry it across the sweep air stream so that it falls upon the main fuel filmer lip and is entrained in an outer main air stream.

9 Claims, 4 Drawing Sheets

U.S. PATENT DOCUMENTS

| | | | | | |
|---|---|---|---|---|---|
| 5,603,211 | A | | 2/1997 | Graves | 60/39.06 |
| 5,613,363 | A | | 3/1997 | Joshi et al. | 60/737 |
| 5,701,732 | A | | 12/1997 | Nesbitt et al. | 60/742 |
| 5,737,921 | A | | 4/1998 | Jones et al. | 60/748 |
| 5,816,050 | A | | 10/1998 | Sjunnesson et al. | 60/748 |
| 5,822,992 | A | * | 10/1998 | Dean | 60/737 |
| 5,960,724 | A | | 10/1999 | Toqan et al. | 431/182 |
| 5,987,889 | A | | 11/1999 | Graves et al. | 60/748 |
| 6,101,814 | A | | 8/2000 | Hoke et al. | 60/748 |
| 6,189,314 | B1 | | 2/2001 | Yamamoto et al. | 60/746 |
| 6,272,840 | B1 | * | 8/2001 | Crocker et al. | 60/776 |
| 6,378,310 | B1 | * | 4/2002 | Le Gal et al. | 60/760 |
| 6,415,610 | B1 | * | 7/2002 | Parker | 60/798 |

* cited by examiner

SINGLE-CIRCUIT FUEL INJECTOR FOR GAS TURBINE COMBUSTORS

GOVERNMENT SUPPORT

The invention was made with U.S. Government support under Contract No. DAAJ02-97-C-0018 awarded by the U.S. Army under the Small Business Innovative Research (SBIR) Program Project. The Government has certain rights in this invention.

BACKGROUND OF THE INVENTION

1. Field of the Invention

The present invention relates generally to fuel injection assemblies for gas turbine engines, and more particularly, but not by way of limitation, to relatively small-size, high-performance fuel injectors of a type useful for rotary wing aircraft. The invention is also useful in applications where a lean direct injector is desired to reduce nitrous oxide (NOx) emissions.

2. Description of the Prior Art

There is an ongoing need in the art of advanced gas turbine combustors for fuel nozzles that can provide good atomization and fuel-air mixing; a high fuel-to-air turndown ratio; and good high temperature performance, such as to provide resistance to fuel coking.

A high temperature fuel nozzle design program was funded by the Naval Air Propulsion Center about 1990. Two papers discussing technologies for thermal insulation of fuel passages for different types of nozzles were published. The first is ASME 92-GT-132, "Innovative High Temperature Aircraft Engine Fuel Nozzle Design" by Stickles, et al. (1992). The second is "Development of an Innovative High-Temperature Gas Turbine Fuel Nozzle", by Meyers, et al, J. of Engr. for Gas Turbines and Power, Vol. 114, p. 401 (1992).

Another line of development work in the field of high performance fuel injectors for gas turbine engines is that group of designs referred to as lean direct injection (LDI) designs. Lean direct injection designs seek to rapidly mix the fuel and air to a lean stoichiometry after injection into the combustor. If the mixing occurs very rapidly, the opportunity for near stoichiometric burning is limited, resulting in low NOx production.

Also, the prior art has included injectors using fuel momentum to direct fuel across an air stream. U.S. Pat. No. 4,854,127 to Vinson et al. discloses at FIGS. 6–8 thereof a momentum staged injector wherein at high power operation the momentum of a fuel jet carries the fuel across a central air stream to reach an outer fuel filmer lip.

There is a continuing need for improvement in the design of high performance fuel injectors for gas turbines. In some instances the primary focus is upon stable low power performance. In others relative size and power output are critical. In still others low NOx emissions are critical.

SUMMARY OF THE INVENTION

The present invention provides improvements upon the injector design having a bifurcated recirculation zone as disclosed in the referenced Crocker et al. application, and particularly the present invention provides a design that is especially useful for relatively small-sized, high-performance combustors. The present design enables stable combustion at low power and provides good fuel-air distribution and mixing at high power. The high-power mixing results in low pattern factor and/or low NOx emissions. Furthermore, the design is capable of achieving the required low-power and high-power performance with a single fuel circuit.

In a first embodiment, a fuel injector apparatus includes a tip body having an aft facing tapered surface, the tip body having a fuel passage defined therein, and having at least one fuel injection port communicating the fuel passage with an exterior of the tip body. The apparatus further includes a central air supply conduit having a radially inward tapered aft portion disposed concentrically about and spaced radially from the aft facing tapered surface of the tip body to define an air sweep passage oriented to direct a central air stream aft and radially inward. A main fuel filmer lip is located concentrically about the tip body and in a path from the fuel injection ports. In a low pressure operating mode, fuel is entrained in the central air stream from the atomizer tip. In a high-power operating mode, fuel penetrates the central air stream and impinges upon the fuel filmer lip where it is air blast atomized by the main air stream flowing past the fuel filmer lip.

In another embodiment a fuel injection apparatus includes a fuel injector, one and only one fuel supply circuit communicated with the fuel injector, and the fuel injector has air supply conduits defining a central air stream, a main air stream and a bifurcated recirculation zone separating the central air stream from the main air stream. The central air stream is axial so that there is no axial recirculation on the centerline. At least one fuel injection port is communicated with the fuel supply circuit and oriented such that at fuel supply pressures within a low power operating range a majority of fuel is entrained in the central air stream, and at fuel supply pressures within a high pressure operating range a majority of injected fuel is entrained in the main air stream.

In another embodiment, methods of injecting fuel into a combustor are provided. The methods include:

(a) providing a fuel injector;

(b) flowing a central air stream over the fuel injector, the central air stream becoming axial downstream of the fuel injector and having no axial recirculation zone;

(c) flowing a main air stream concentrically outside of the central air stream;

(d) creating a bifurcated recirculation zone separating the central air stream from the main air stream; and (e) providing fuel to the fuel injector, during both a low power operating mode and a high power operating mode, through a single fuel supply path, fuel being supplied during the lower power operating mode at a pressure with a first pressure range such that a majority of the fuel is entrained in the central air stream, and fuel being supplied during the high power operating mode at a pressure within a second pressure range, higher than the first pressure range, such that a majority of the fuel penetrates the central air stream and is entrained in the main air stream.

It is therefore an object of the present invention to provide improved high performance fuel injection apparatus for gas turbine combustors.

Another object of the present invention is the provision of a fuel injection apparatus which enables stable combustion at low power and good fuel-air distribution and mixing at high power.

Another object of the present invention is the provision of relatively small, high-performance fuel injectors.

And another object of the present invention is the provision of simple fuel injectors which are economical to manufacture.

Still another object of the present invention is the provision of fuel injectors that result in low pattern factor.

And another object of the present invention is the provision of fuel injectors which provide for low NOx emissions.

Still another object of the present invention is the provision of fuel injectors which provide good atomization and fuel-air mixing.

And another object of the present invention is the provision of fuel injectors having a high fuel-to-air turndown ratio.

Still another object of the present invention is the provision of fuel injector apparatus having good high temperature performance as evidenced by resistance to fuel coking in the fuel passages and fuel injection ports.

Other and further objects features and advantages of the present invention will be readily apparent to those skilled in the art upon a reading of the following disclosure when taken in conjunction with the accompanying drawings.

DETAILED DESCRIPTION OF THE PREFERRED EMBODIMENTS

One recent development in the field of LDI injectors is that shown in U.S. patent application Ser. No. 09/649,518 of Crocker et al. entitled "Piloted Air Blast Lean Direct Fuel Injector" filed Aug. 29, 2000 and assigned to the assignee of the present invention, the details of which are incorporated herein by reference. One feature introduced by the referenced Crocker et al. design is the use of a bifurcated recirculation zone which separates a central axial air stream from a conical outer main air stream. In the pilot or low power operating mode of the burner, fuel is directed solely or primarily to the central axial air stream and the bifurcated recirculation zone. In the high power operating mode fuel is directed primarily to the conical outer main air stream. The present invention provides further improvements on the Crocker et al. design.

Figure 1:
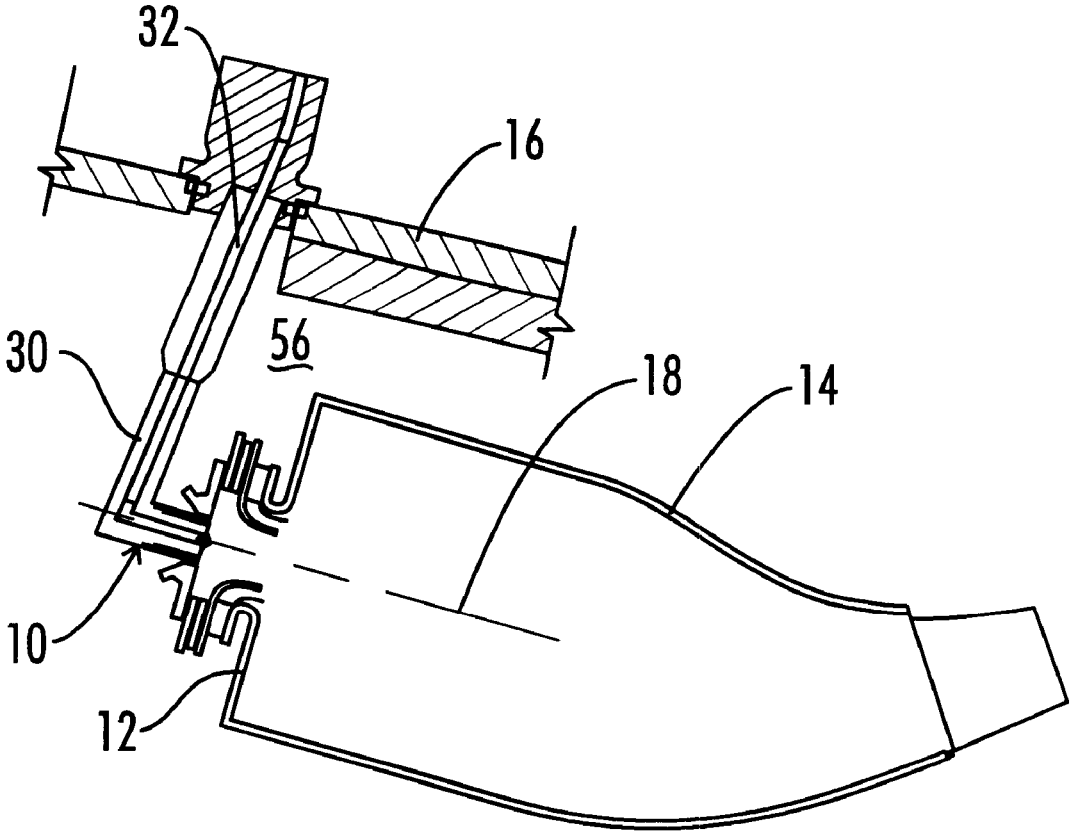
FIG. 1 is a cross section drawing of a typical combustor for a gas turbine, with the fuel injector apparatus of the present invention in place on a typical combustor inlet.

Referring now to the drawings, and particularly to FIG. 1, a fuel injector apparatus is shown and generally designated by the numeral 10. The fuel injection apparatus 10 is mounted in the dome 12 of a combustor 14 of a gas turbine engine case 16. The fuel injector apparatus 10 has a central axis 18.

Figure 2:
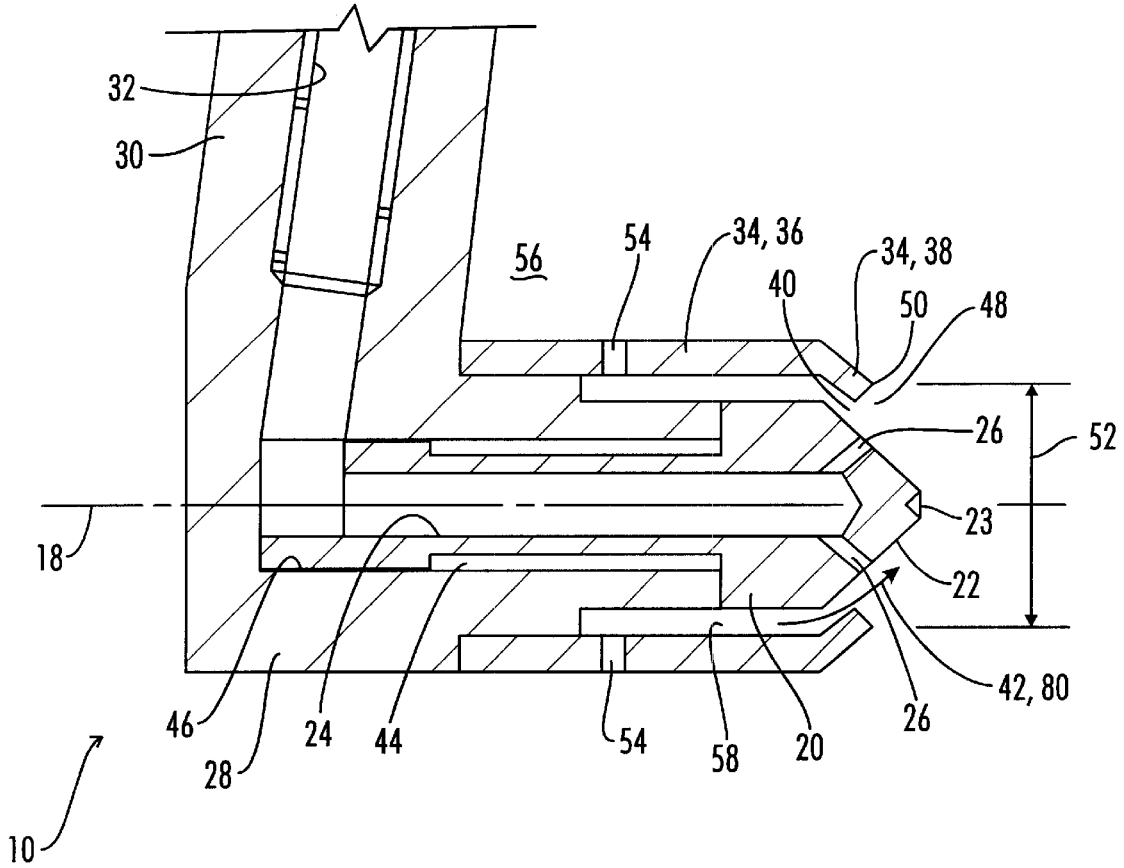
FIG. 2 is an enlarged cross sectional view of the tip of the fuel injector apparatus of the present invention.

As seen in the enlarged view of FIG. 2, the fuel injector apparatus 10 includes a tip body 20 having an aft facing tapered surface 22 with concave tip end 23, and having an axial fuel passage 24 defined therein. The tip body 20 has at least one fuel injection port 26, and preferably a plurality of circumferentially spaced such ports 26. Ports 26 communicate the fuel passage 24 with the aft facing tapered surface 22, which may be more generally described as an exterior 22 of the tip body 20. The tip body 20 is mounted on a tip holder 28 which is mounted upon an injector stem 30 which has a fuel supply passage 32 defined therein.

The ports 26 are preferably arranged in a circumferentially equally spaced pattern about the center line 18. In one preferred embodiment, there are five such ports 26 spaced at angles of 72° apart about the center line 18.

A central air supply conduit 34 is mounted upon the tip holder 28 concentrically about the tip body 20. The central air supply conduit 34 has a cylindrical forward portion 36 and has a radially inwardly tapered aft portion 38 disposed concentrically about and spaced radially from the aft facing tapered surface 22 of the tip body 24 to define an air sweep passage 40 oriented to direct a sweep air stream 42 aft and radially inward along the aft facing tapered surface 22 of tip body 20. As further described below, the sweep air stream 42 is part of a central air stream 80.

The tapered aft portion 38 of central air supply conduit 34 may also be described as a frusto-conical tapered aft portion 38.

In the preferred embodiment illustrated, the aft facing tapered surface 22 is tapered at an angle of approximately 45° to the central axis 18, and the fuel injection ports 26 are located also at an angle of about 45° to the central axis 18 so that the fuel injection ports 26 are oriented substantially perpendicular to the tapered aft facing surface 22.

An annular insulating gap 44 defined between the tip body 20 and a bore 46 of tip holder 28 aids in insulating the fuel contained in the center line fuel passage 24 from the heat of combustion within the combustor 14. This provides good resistance to coking of fuel in passage 24.

The downstream or aft portion 38 of central air supply conduit 34 terminates in a circular outlet 48 defined by trailing edge 50 and having a diameter indicated at 52.

It is noted that this aft end trailing edge 50 of central air supply conduit 34 is located forward of a trajectory path from the fuel injection ports 26 so that a stream of fuel exiting the fuel injection ports 26 is not directed against the interior of the central air supply conduit 34.

The cylindrical forward portion 36 of central air supply conduit 34 has a plurality of sweep air feed ports 54 defined therein which allow air to flow inward from the turbine air supply chamber 56. It is noted that in the preferred embodiment there are no swirlers associated with the sweep air feed ports 54. The sweep air or central air stream 42, 80 flows in through the radial ports 54 then axially through the annulus 58 where it is turned radially inward through sweep passage 40 by the tapered aft portion 38 of central air supply conduit 34. However, it is within the scope of the invention to add a swirling motion to the central air stream 42, 80.

Figure 3:
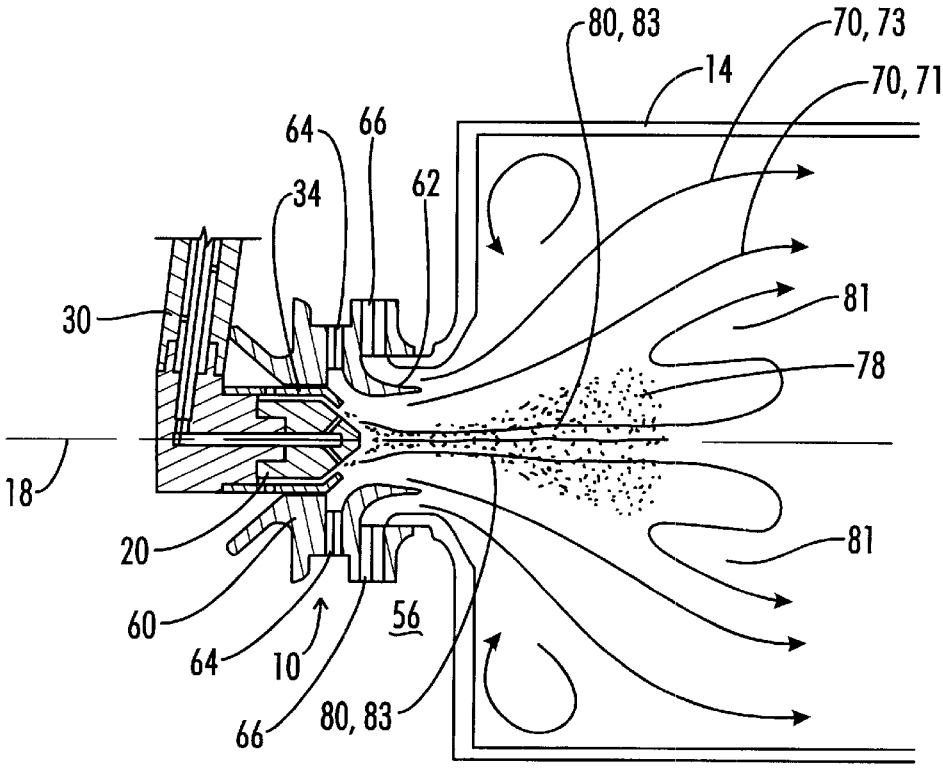
FIG. 3 is a cross sectional view of the fuel injector apparatus of the present invention including the tip of FIG. 2 and including the main fuel filmer lip and main fuel air supply passages, and schematically showing in cross section the forward portion of the combustor chamber, with the fuel spray depicting the fuel flow path for a low power operating mode of the injector apparatus.
Figure 4:
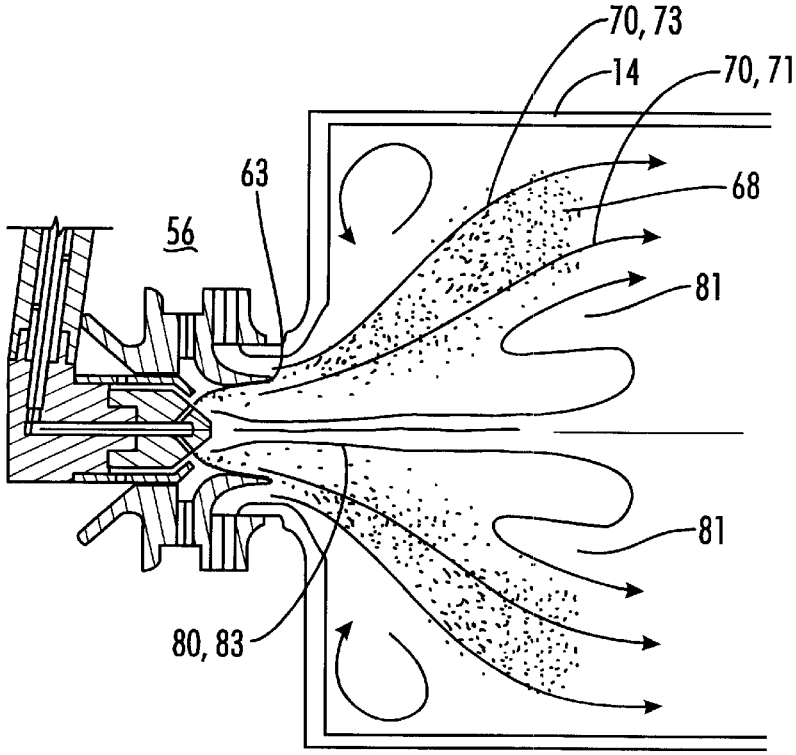
FIG. 4 is a view similar to FIG. 3 wherein the fuel spray depicts the fuel flow during a high power operating mode of the apparatus.

Referring now to FIGS. 3 and 4, a main swirler assembly 60 is mounted concentrically about the central air conduit 34. The main swirler assembly 60 includes a main fuel filmer lip 62 located concentrically about the tip body 20. It is noted that the main fuel filmer lip 62 lies directly in a path of the trajectory from the fuel injection ports 26. As will be further described below, in a high power operating mode of the fuel injector 10, liquid fuel from ports 26 will be sprayed upon the fuel filmer lip 62.

The main swirler assembly 60 also has defined therein inner and outer main swirlers 64 and 66. Swirlers 64 and 66 direct a main air stream 70 from air supply chamber 56 to the radially inside and outside, respectively of the main fuel filmer lip 62 to entrain a main fuel stream 68 (see FIG. 4) from the main fuel filmer lip.

The main swirler assembly 60 with inner and outer main swirlers 64 and 66 may alternatively be described as a main air supply conduit 60, 64, 66 oriented to direct the main air stream 70 aft past the main fuel filmer lip 62 to entrain the main fuel stream 68 from the main fuel firmer lip 62. The radially inner and outer boundaries of main air stream 70 are generally indicated by flow lines 71 and 73, respectively.

The central air supply conduit 34 having the radially inward tapered aft end portion 38 also functions as an air splitter which divides the central or pilot air stream 80 exiting outlet 48 from the main air stream 70 exiting the inner and outer main swirlers 64 and 66, whereby a bifurcated recirculation zone 81 is created between the central air stream 80 and the main air stream 70.

In FIGS. 3 and 4 the outer edge of the central air stream 80 is schematically designated by arrows 83 and the inner edge of the main air stream 70 is schematically designated by the arrows 71. The bifurcated recirculation zone is generally indicated in the area at 81. It will be understood that the bifurcated recirculation zone 81 is a generally hollow conical aerodynamic structure which defines a volume in which there is some axial flow forward opposite to the generally aft flow of the central air stream 80 and main air stream 70. This bifurcated recirculation zone 81 separates the axially aft flow of the central air stream 80 exiting outlet 48 from the axially aft flow of main air stream 70 exiting inner and outer main swirlers 64 and 66. It is noted that there is no central recirculation zone, i.e. no reverse or forward flow along the central axis 18 as would be found in conventional fuel injectors.

When the central air stream 80 is described as having no center line or axial recirculation, it will be understood that this is referring to the area of the distinct identifiable pilot flame which typically might extend downstream a distance on the order of one to two times the diameter 52 shown in FIG. 2. Farther downstream where the combustion products of the pilot flame and main flame converge there could be an element of reverse circulation. Also, immediately downstream of tip end 23 there could be a very small zone of reverse circulation having dimensions on the order of the diameter of tip end 23. Neither of the phenomena just mentioned would be considered to be an axial recirculation of the central air stream 80.

The creation of the bifurcated recirculation zone 81 which aerodynamically isolates the central or pilot flame from the main flame benefits the lean blowout stability of the fuel injector. The pilot fuel stays nearer to the axial center line 18 and entrains into the bifurcated recirculation zone 81 and evaporates there, thus providing a richer burning zone for the pilot flame than is the case for the main flame. Also the flow of central air stream 80 away from tip 23 pushes hot reacting gases away from tip body 20, thus preventing heat damage to tip body 20.

The flame is stabilized in the recirculating region 81 between the two flow streams. This type of recirculating flow can be maintained at a much higher equivalence ratio than a conventional center line recirculation zone for the same amount of fuel flow. The result is superior lean blowout.

The selection of design parameters to create the bifurcated recirculation zone 81 includes consideration of both the diameter 52 of the outlet 48 and the radially inward directed angle of the air sweep passage 40.

A significant amount of air is directed radially inward over the injector tip. This air enters the air sweep passage 58, 40 through the inlet holes 54 spaced around the circumference of the tip at the forward end of the air sweep passage. The flow of air through the air sweep passage is instrumental in controlling the dual mode operation of the injector. At low power, the air sweep exiting tapered air sweep passage portion 40 is strong enough relative to the fuel momentum to push the fuel toward the injector center line 18. Most of the fuel then atomizes off of the tip 23 of the injector. The shape of the tip end 23 has been found to be significant for optimum low power atomization. A concave tip as illustrated, or a blunt tip, have been found to be optimum. The fuel is therefore concentrated near the injector center line 18 for good low power performance. At high power, the majority of the fuel easily penetrates to the main fuel filmer lip 62 where conventional air blast atomization leads to good fuel-air mixing.

Figure 5:
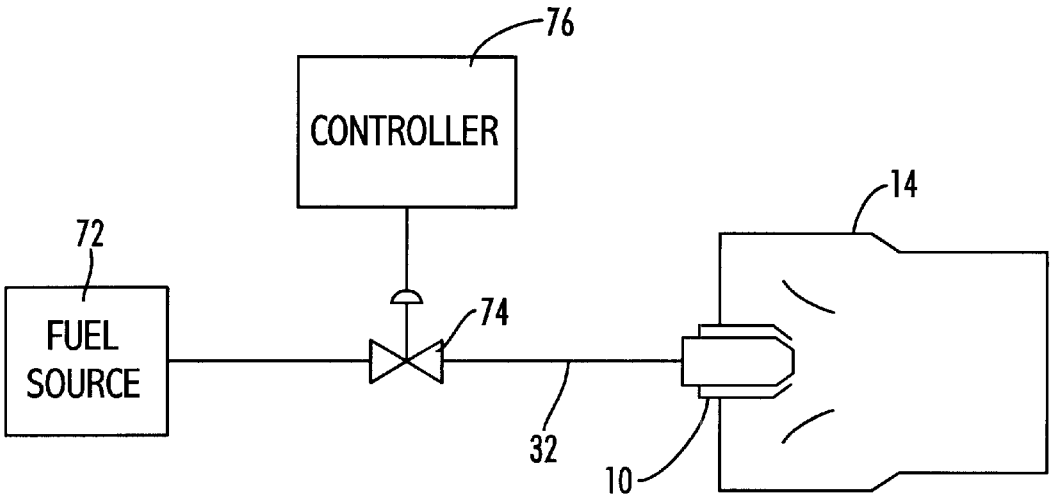
FIG. 5 is a schematic illustration of a control system for controlling the flow of fuel from a fuel source to the fuel injection apparatus.

FIG. 5 schematically illustrates the fuel supply to the fuel injector apparatus 10. The apparatus 10 is designed as a single circuit fuel injector, in that is there is only a single source of fuel provided to the fuel injector. As will be further described below, fuel is provided to the injector 10 at varying pressures in order to control the mode of operation, i e. low power mode or high power mode, of the fuel injector.

Thus fuel from fuel source 72 flows through fuel supply conduit 32 to fuel apparatus 10. A control valve 74 disposed in the fuel supply line 32 is controlled by microprocessor based controller apparatus 76 so as to direct fuel to fuel injector 10 at the desired pressure for the selected operating mode of the fuel injector 10.

FIGS. 3 and 4 schematically illustrate the flow regimes for fuel and air through fuel injector 10 for low power and high power modes, respectively.

In the low power mode illustrated in FIG. 3, liquid fuel is provided to the fuel injector apparatus 10 at a relatively low pressure within a low power range, e.g. from about 0 psi to about 25 psi, such that a majority of the injected fuel is entrained as pilot fuel stream 78 within the central air stream 80 aft of the fuel injector apparatus 10.

In this low power operating mode, as the fuel exits the fuel injection ports 26, its momentum is sufficiently low that the radially inward directed sweep air 42 (see FIG. 2) flowing through sweep air passage 40 causes the fuel to flow downstream in a film across the tapered aft facing surface 22 and prevents all or most of the fuel from reaching the main fuel filmer lip 62.

When the film of fuel reaches the aft end 23 of tip body 20 it is atomized in an air blast fashion into droplets which are entrained as pilot fuel stream 78 in the central air stream 80 and also enter the bifurcated recirculation zone 81. Thus in the low-power operating mode, which may also be referred to as a pilot mode, the flame will be located solely in the central air stream 80 and the bifurcated recirculation zone 81 radially inward of the main air stream 70.

As schematically illustrated in FIG. 4, in a high power operating mode fuel is supplied to the fuel injection ports 26 at a pressure within a high power range, e.g. from about 50 psi to about 500 psi, such that a majority of the injected fuel has sufficient momentum to cross the sweep air portion 42 of central air stream 80 flowing through air sweep passage 40 and to fall upon the inner surface of the main fuel filmer lip 62. That fuel then flows in a film to the aft end 63 of main fuel filmer lip 62 where it is entrained in an air blast fashion by the air flowing through inner and outer main swirlers 64 and 66 so that it is caught up in the main air stream 70 outside of the bifurcated recirculation zone 81. Thus in the high power operating mode, the majority of the fuel flows into the main air stream 70, creating a substantially conically shaped flame anchored outside of the bifurcated recirculation zone 81.

As will be understood by those skilled in the art, an air blast fuel injector such as main fuel filmer lip 62 allows the fuel to flow in an annular film along the filmer lip 62 leading to its aft end 63. The annular film of liquid fuel is then entrained in the much more rapidly moving and swirling air streams from inner and outer main swirlers 64 and 66, which air streams cause the annular film of liquid fuel to be atomized into small droplets which are entrained as the main fuel stream 68. Preferably the design of the main fuel injector is such that the main fuel is entrained approximately mid stream between the air streams exiting the inner and outer main swirlers 64 and 66. In the embodiment illustrated, the inner and outer main swirlers 64 and 66 are shown as radial swirlers. It will be understood that axial vane type swirlers could also be utilized. The inner and outer main swirlers may be either counter swirl or co swirl.

Although not specifically illustrated in FIGS. 3 and 4, it will be understood that there is of course an intermediate phase of operation, as the supply fuel pressure is increased beyond the lower range toward the higher range, during which aspects of both the low power mode of FIG. 3 and the high power mode of FIG. 4 will be simultaneously present.

It will be appreciated that in a typical fuel injection system the air sweep passage 58, 40 and the inner and outer main swirlers 64 and 66 are fed from a common air supply chamber 56, and the relative volumes of air which flow through each of the passages are dependent upon the sizing and geometry of the passages and the fluid flow restriction to flow through those passages which is provided by the various openings, swirlers and the like. In one preferred embodiment of the invention the passages and swirlers are constructed such that from about 2 to about 20% of total air flow goes through the air sweep passage 58, 40; from about 20 to about 50% of total air flow is through the inner main swirler 64, and the balance of total air flow is through the outer main swirler 66.

The methods of injecting fuel using the apparatus 10 may be generally described as including the steps of:

(a) providing the fuel injector apparatus 10;

(b) flowing a central air stream 80 over the fuel injector apparatus 10, the central air stream 80 becoming axial downstream of the fuel injector and having no, or significantly delayed, axial recirculation zone;

(c) flowing a main air stream 70 concentrically outside of the central air stream 80;

(d) creating a bifurcated recirculation zone 81 separating the central air stream 80 from the main air stream 70; and (e) providing fuel to the fuel injector 10, during both a low-power operating mode and a high-power operating mode, through a single fuel supply passage 24, the fuel being supplied during the low-power operating mode at a pressure within a first pressure range such that a majority of the fuel is entrained in the central air stream 80, and fuel being supplied during the high power operating mode at a pressure within a second pressure range, higher than the first pressure range, such that a majority of the fuel penetrates the central air stream 80 and is entrained in the main air stream 70.

Thus a fuel injector apparatus 10 is provided which is a single circuit injector that has dual operating modes for good low-power and high-power performance. The apparatus 10 is ideally suited for advanced gas turbine combustor applications because it is a simple, single circuit injector with associated advantages of good durability for high temperature operations and relatively low cost. At the same time, its dual mode operation provides the necessary operability.

Thus it is seen that the apparatus and methods of the present invention readily achieves the ends and advantages mentioned, as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A fuel injection apparatus for a gas turbine, comprising:

a fuel injector;

one and only one fuel supply circuit, communicated with the fuel injector; and the fuel injector having:

air supply conduits defining a central air stream, a main air stream and a bifurcated recirculation zone separating the central air stream from the main air stream, the central air stream being axial so that there is no axial recirculation; and at least one fuel injection port communicated with the fuel supply circuit and oriented such that at fuel supply pressures within a low power operating range a majority of injected fuel is entrained in the central air stream, and at fuel supply pressures within a high power operating range a majority of injected fuel is entrained in the main air stream.

2. The apparatus of claim 1, wherein:

the air supply conduits include a central air supply conduit having a frusto-conical tapered aft portion arranged to split the central air stream from the main air stream to create the bifurcated recirculation zone.

3. The apparatus of claim 2, wherein:

the fuel injector includes an at least partially conical aft facing outer surface located concentrically within and spaced from the frusto-conical tapered aft portion of the central air supply conduit.

4. The apparatus of claim 3, further comprising:

a main fuel filmer lip disposed concentrically outside of and extending aft of the central air supply conduit; and wherein the fuel injector includes a plurality of fuel injection ports, including the at least one fuel injection port, arranged around a circumference of the aft facing outer surface and oriented so that a trajectory of a fuel jet from each fuel injection port is directed toward the main fuel filmer lip.

5. A method of injecting fuel into a combustor, comprising:

(a) providing a fuel injector;

(b) flowing a central air stream over the fuel injector, the central air stream becoming axial downstream of the fuel injector and having no axial recirculation zone;

(c) flowing a main air stream concentrically outside of the central air stream;

(d) creating a bifurcated recirculation zone separating the central air stream from the main air stream; and (e) providing fuel to the fuel injector, during both a low power operating mode and a high power operating mode, through a single fuel supply path, fuel being supplied during the low power operating mode at a pressure within a first pressure range such that a majority of the fuel is entrained in the central air stream, and fuel being supplied during the high power operating mode at a pressure within a second pressure range, higher than the first pressure range, such that a majority of the fuel penetrates the central air stream and is entrained in the main air stream.

6. The method of claim 5, wherein:

step (b) includes directing the central air stream radially inward over an aft facing tapered surface of the fuel injector.

7. The method of claim 5, further comprising:

during the high power operating mode of step (e), receiving fuel from the fuel injector on a main fuel filmer lip disposed in the main air stream so that the fuel is atomized by the main air stream flowing past the main fuel filmer lip.

8. The method of claim 7, wherein:

step (c) includes flowing an outer main air stream portion outside of the main fuel filmer lip, and flowing an inner main air stream portion inside of the main fuel filmer lip, and swirling both the outer and inner main air stream portions upstream of the main fuel filmer lip.

9. The method of claim 8, wherein:

in step (b) the central air stream is a linear non-swirled air stream.

* * * * *